US007881926B2

(12) United States Patent
Joublin et al.

(10) Patent No.: US 7,881,926 B2
(45) Date of Patent: Feb. 1, 2011

(54) JOINT ESTIMATION OF FORMANT TRAJECTORIES VIA BAYESIAN TECHNIQUES AND ADAPTIVE SEGMENTATION

(75) Inventors: Frank Joublin, Mainhausen (DE); Martin Heckmann, Frankfurt am Main (DE); Claudius Glaeser, Offenbach am Main (DE)

(73) Assignee: Honda Research Institute Europe GmbH, Offenbach/Main (DE)

( * ) Notice: Subject to any disclaimer, the term of this patent is extended or adjusted under 35 U.S.C. 154(b) by 803 days.

(21) Appl. No.: 11/858,743

(22) Filed: Sep. 20, 2007

(65) Prior Publication Data

US 2008/0082322 A1 Apr. 3, 2008

(30) Foreign Application Priority Data

Sep. 29, 2006 (EP) ..... 06020643

(51) Int. Cl.
*G10L 21/00* (2006.01)
*G10L 19/06* (2006.01)

(52) U.S. Cl. ..... 704/209; 704/205

(58) Field of Classification Search ..... None
See application file for complete search history.

(56) References Cited

U.S. PATENT DOCUMENTS 3,649,765 A * 3/1972 Rabiner et al. ..... 704/209
7,424,423 B2 * 9/2008 Bazzi et al. ..... 704/209
7,756,703 B2 * 7/2010 Lee et al. ..... 704/209
2001/0021904 A1 * 9/2001 Plumpe ..... 704/209

OTHER PUBLICATIONS

Acero, A., "Formant Analysis and Synthesis Using Hidden Markov Models," Proc. Eurospeech, 1999, pp. 1047-1050, vol. 1.
Deng, L. et al., "A Database of Vocal Tract Resonance Trajectories for Research in Speech Processing," Proceedings of the IEEE International Conference on Acoustics, Speech and Signal Processing (ICASSP), Toulouse, France, May 2006, pp. 60-63.
European Search Report, European Application No. 06020643, Jan. 26, 2007, 6 pages.
Garofolo, J.S. et al., "DARPA TIMIT Acoustic Phonetic Speech Corpus," Tech. Rep. NISTIR 4930, U.S. Department of Commerce, NIST, Computer Systems Laboratory, Washington, DC, USA, 1993.
Godsill, S.J. et al., "Monte Carlo Smoothing for Nonlinear Time Series," Journal of the American Statistical Association, Mar. 2004, pp. 156-168, vol. 99, No. 465.
Malkin, J. et al., "A Graphical Model for Formant Tracking," Proceedings of the IEEE International Conference on Acoustics, Speech, and Signal Processing, 2005, (ICASSP '05), Philadelphia, PA, USA, Mar. 18-23, 2005, pp. 913-916.

(Continued)

*Primary Examiner*—David R Hudspeth
*Assistant Examiner*—Samuel G Neway
(74) *Attorney, Agent, or Firm*—Fenwick & West LLP

(57) ABSTRACT

The invention relates to the field of automated processing of speech signals and particularly to a method for tracking the formant frequencies in a speech signal, comprising the steps of: obtaining an auditory image of the speech signal; sequentially estimating formant locations; segmenting the frequency range into sub-regions; smoothing the obtained component filtering distributions; and calculating exact formant locations.

14 Claims, 4 Drawing Sheets

OTHER PUBLICATIONS

Mustafa, K. et al., "Robust Formant Tracking for Continuous Speech with Speaker Variability," IEEE Transactions on Audio, Speech and Language Processing, Mar. 2006, pp. 435-444, vol. 14, No. 2.

Shi, Y. et al., "Spectrogram-Based Formant Tracking Via Particle Filters," 2003 IEEE International Conference on Acoustics, Speech and Signal Processing, IEEE Piscataway, NJ, USA, 2003, pp. 168-171, vol. 1.

Vermaak, J. et al. "Maintaining Multimodality Through Mixture Tracking," Proceedings of the Eighth IEEE International Conference on Computer Vision (ICCV), Nice, France, IEEE Comp. Soc. US, Oct. 13-16, 2003, pp. 1110-1116, vol. 2.

Zheng, Y. et al., "Particle Filtering Approach to Bayesian Formant Tracking," Statistical Signal Processing, 2003 IEEE Workshop on St. Louis, MO, USA, Sep. 28-Oct. 1, 2003, pp. 601-604.

* cited by examiner

JOINT ESTIMATION OF FORMANT TRAJECTORIES VIA BAYESIAN TECHNIQUES AND ADAPTIVE SEGMENTATION

FIELD OF INVENTION

The present invention relates generally to automated processing of speech signals, and particularly to tracking or enhancing formants in speech signals. The formants and their variations in time are important characteristics of speech signals. The present invention may be used as a preprocessing step in order to improve the results of a subsequent automatic recognition, synthesis or imitation of speech with a formant based synthesizer.

BACKGROUND OF THE INVENTION

Automatic speech recognition is a field with a multitude of possible applications. In order to recognize the speech, sound must be identified from a speech signal. The formant frequencies are very important cues for the recognition of speech sounds. The formant frequencies depend on the shape of the vocal tract and are the resonances of the vocal tract. The formant tracks may also be used to develop formant based speech synthesis systems that learn to produce the speech sounds by extracting the formant tracks from examples and then reproducing the speech sounds.

Only few attempts were made to use Bayesian techniques to track formants. See Y. Zheng and M. Hasegawa-Johnson, "Particle Filtering Approach to Bayesian Formant Tracking," IEEE Workshop on Statistical Signal Processing, pp. 601-604, 2003. Most of such attempts, however, use single tracker instances for each formant and thus perform an independent formant tracking.

SUMMARY OF THE INVENTION

It is an object of the invention to provide a method for tracking formants in speech signals with better performance, in particular when the spectral gap between formants is small. It is a further object of the invention to provide a method for tracking formants in speech signals that is robust against noise and clutter.

In one embodiment of the present invention, an auditory image of the speech signal is generated from the speech signal. Then the formant locations are sequentially estimated from the auditory image. The frequency range of the auditory image is segmented into sub-regions. Then component filtering distributions are smoothed. The exact formant locations are calculated based on the smoothed component filtering distributions.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

BRIEF DESCRIPTION OF THE FIGURES

The teachings of the present invention can be readily understood by considering the following detailed description in conjunction with the accompanying drawings.

DETAILED DESCRIPTION OF THE INVENTION

Figure 1:
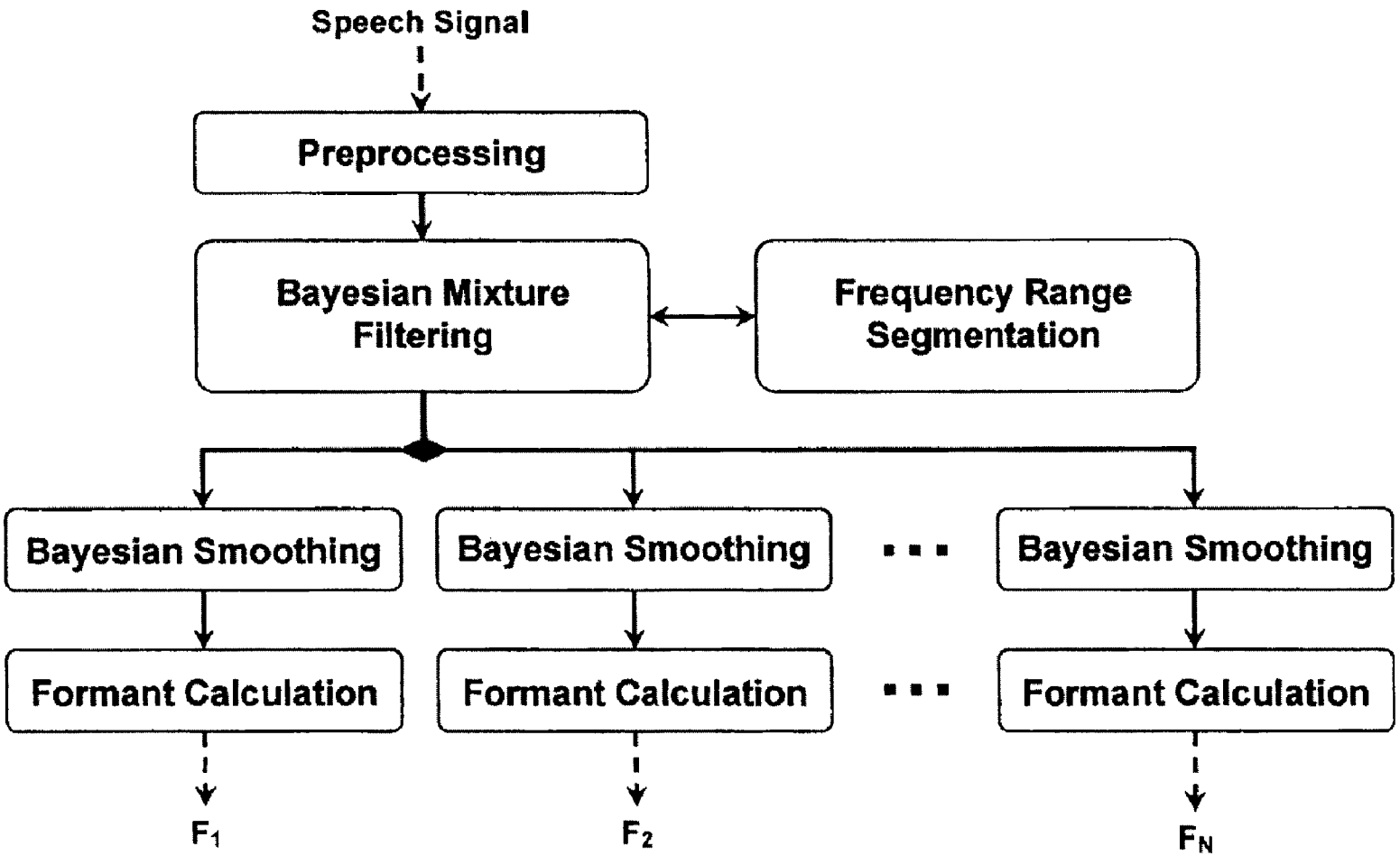
FIG. 1 is a diagram illustrating an overall architecture of a formant tracking system, according to one embodiment of the present invention.

Reference in the specification to "one embodiment" or to "an embodiment" means that a particular feature, structure, or characteristic described in connection with the embodiments is included in at least one embodiment of the invention. The appearances of the phrase "in one embodiment" in various places in the specification are not necessarily all referring to the same embodiment.

Some portions of the detailed description that follows are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic or optical signals capable of being stored, transferred, combined, compared and otherwise manipulated. It is convenient at times, principally for reasons of common usage, to refer to these signals as bits, values, elements, symbols, characters, terms, numbers, or the like. Furthermore, it is also convenient at times, to refer to certain arrangements of steps requiring physical manipulations of physical quantities as modules or code devices, without loss of generality.

However, all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or "determining" or the like, refer to the action and processes of a computer system, or similar electronic computing device, that manipulates and transforms data represented as physical (electronic) quantities within the computer system memories or registers or other such information storage, transmission or display devices.

Certain aspects of the present invention include process steps and instructions described herein in the form of an algorithm. It should be noted that the process steps and instructions of the present invention could be embodied in software, firmware or hardware, and when embodied in software, could be downloaded to reside on and be operated from different platforms used by a variety of operating systems.

The present invention also relates to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Furthermore, the computers referred to in the specification may include a single processor or may be architectures employing multiple processor designs for increased computing capability.

The algorithms and displays presented herein are not inherently related to any particular computer or other apparatus. Various general-purpose systems may also be used with programs in accordance with the teachings herein, or it may prove convenient to construct more specialized apparatus to perform the required method steps. The required structure for a variety of these systems will appear from the description below. In addition, the present invention is not described with reference to any particular programming language. It will be appreciated that a variety of programming languages may be used to implement the teachings of the present invention as described herein, and any references below to specific languages are provided for disclosure of enablement and best mode of the present invention.

In addition, the language used in the specification has been principally selected for readability and instructional purposes, and may not have been selected to delineate or circumscribe the inventive subject matter. Accordingly, the disclosure of the present invention is intended to be illustrative, but not limiting, of the scope of the invention, which is set forth in the following claims.

The present invention is directed to biologically plausible and robust methods for formant tracking. The method according to embodiments of the present invention tracks the formants using Bayesian techniques in conjunction with adaptive segmentation.

FIG. 1 is a diagram illustrating an overall architecture of a formant tracking system, according to one embodiment of the invention. The system may be implemented by a computing system having acoustical sensing means.

One embodiment of the present invention works in the spectral domain as derived from the application of a Gammatone filterbank on the signal. At the first preprocessing stage, the raw speech signal received by acoustical sensing means as sound pressure waves in a person's farfield is transformed into the spectro-temporal domain. The transformation may be achieved by using Patterson-Holdsworth auditory filterbank that transforms complex sound stimuli like speech into a multi-channel activity pattern similar to what is observed in the auditory nerve. The multi-channel activity pattern is then converted into a spectrogram, also known as the auditory image. A Gammatone filterbank that consists of 128 channels covering the frequency range, for example, from 80 Hz to 8 kHz may be used.

In one embodiment of the invention, a technique for the enhancement of formants in spectrograms may be used before using the method according to embodiments of the present invention. The technique for enhancing the formants include the technique, for example, as disclosed in the pending European patent application EP 06 008 675.9, which is incorporated by reference herein in its entirety. Any other techniques for transforming into the spectral domain (for example, FFT, LPC) and the enhancing formants in the spectral domain may also be used instead of the technique disclosed in the pending European patent application EP 06 008 675.9.

More particularly, in order to enhance formant structures in spectrograms, the spectral effects of all components involved in the speech production must be considered. A second-order low-pass filter unit may approximate the glottal flow spectrum. The glottal spectrum may be modeled by a monotonically decreasing function with a slope of −12 dB/oct. The relationship of lip volume velocity and sound pressure received at some distance from the mouth may be described by a first-order high pass filter, which changes the spectral characteristics by +6 dB/oct. Thus, an overall influence of −6 db/oct may be corrected using inverse filtering by emphasizing higher frequencies with +6 dB/oct. After the above mentioned preemphasis is achieved, the formants may be extracted from these spectrograms. This may be done by smoothing along the frequency axis, which causes the harmonics to spread and further form peaks at formant locations. Therefore, a Mexican Hat operator may be applied to the signal where the kernel's parameters may be adjusted to the logarithmic arrangement of the Gammatone filterbank's channel center frequencies. In addition, the filter responses may be normalized by the maximum at each sample and a sigmoid function may be applied so that the formants may become visible in signal parts with relatively low energy and values may be converted into the range [0,1].

In one embodiment according to the present invention, a recursive Bayesian filter unit may be applied in order to track formants. The formant locations are sequentially estimated based on predefined formant dynamics and measurements embodied in the spectrogram. The filtering distribution may be modeled by a mixture of component distributions with associated weights so that each formant under consideration is covered by one component. By doing so, the components independently evolve over time and only interact in the computation of the associated mixture weights.

More specifically, two general problems arise while tracking multiple formants. The first problem is the sequential estimation of states encoding formant locations based on noisy observations. Bayesian filtering techniques were proven to work robustly in such environment.

The second much difficult problem is widely known as a data association problem. Due to unlabeled measurements, the allocation of them to one of the formants is a crucial step in order to resolve ambiguities. As in the case of tracking the formants, this can not be achieved by focusing on only one target. Rather the joint distribution of targets in conjunction with temporal constraints and target interactions must be considered.

In one embodiment of the present invention, the second problem was solved by applying a two-stage procedure. First, a Bayesian filtering technique is applied to the signal. The Bayesian filtering technique solves the data association problem by considering continuity constraints and formant interactions. Subsequently, a Bayesian smoothing method is used in order to resolve ambiguities resulting in continuous formant trajectories.

Bayes filters represent the state at time t by random variables $x_t$, whereas uncertainty is introduced by a probabilistic distribution over $x_t$, called the belief $Bel(x_t)$. The Bayes filters aim to sequentially estimate such beliefs over the state space conditioned on all information contained in the sensor data. Let $z_t$ denote the observation at a normalization constant, and t denote the standard Bayes filter recursion time. Then, the following equation may be derived:

$$Bel^{-}(x_t)=\int p(x_t|x_{t-1})\cdot Bel(x_{t-1})dx_{t-1} \quad (1)$$

$$Bel(x_t)=\alpha\cdot p(z_t|x_t)\cdot Bel^{-}(x_t) \quad (2)$$

One crucial requirement while tracking the multiple formants in conjunction is the maintenance of multimodality. Standard Bayes filters allow the pursuit of multiple hypotheses. Nevertheless, these filters can maintain multimodality only over a defined time-window in practical implementations. Longer durations cause the belief to migrate to one of the modes, subsequently discarding all other modes. Thus the standard Bayes filters are not suitable for multi-target tracking as in the case of tracking formants.

In one embodiment of the present invention the mixture filtering technique, for example, as disclosed in J. Vermaak et al. "Maintaining multimodality through mixture tracking," Proceedings of the Ninth IEEE International Conference on Computer Vision (ICCV), Nice, France, October 2003, vol. 2, pp. 1110-1116 is applied to the problem of tracking formants in order to avoid these problems. The key issue in this approach is that the formulation of the joint distribution Bel $(x_t)$ through a non-parametric mixture of M component beliefs $Bel_m(x_t)$ so that each target is covered by one mixture component.

$$Bel(x_t) = \sum_{m=1}^{M} \pi_{m,t} \cdot Bel_m(x_t) \tag{3}$$

Accordingly, the two-stage standard Bayes recursion for the sequential estimation of states may be reformulated with respect to the mixture modeling approach.

Furthermore, because the state space is already discretized by application of the Gammatone filterbank and the number of used channels is manageable, a grid-based approximation may be used as an adequate representation of the belief. In other alternative embodiments, any other approximation of filtering distributions (for example, approximation used in Kalman filters or particle filters) may be used instead.

Assuming that N filter channels are used, the state space may be written as $X=\{x_1, x_2, \ldots, x_N\}$. Hence, the resulting formulas for the prediction and update steps are:

$$Bel^{-}(x_{k,t}) = \sum_{m=1}^{M} \pi_{m,t-1} \cdot Bel_m^{-}(x_{k,t-1}) \tag{4}$$

$$Bel(x_{k,t}) = \sum_{m=1}^{M} \pi_{m,t} \cdot Bel_m(x_{x,t}) \tag{5}$$

where $$Bel_m^{-}(x_{k,t}) = \sum_{l=1}^{N} p(x_{k,t} \mid x_{l,t-1}) Bel_m(x_{l,t-1}) \tag{6}$$

$$Bel_m(x_{k,t}) = \frac{p(z_t \mid x_{k,t}) Bel_m^{-}(x_{k,t})}{\sum_{l=1}^{N} p(z_t \mid x_{l,t}) Bel_m(x_{l,t})} \tag{7}$$

$$\pi_{m,t} = \frac{\pi_{m,t-1} \sum_{k=1}^{N} p(z_t \mid x_{k,t}) Bel_m^{-}(x_{k,t})}{\sum_{n=1}^{M} \pi_{n,t-1} \sum_{l=1}^{N} p(z_t \mid x_{l,t}) Bel_n^{-}(x_{l,t})} \tag{8}$$

Thus, the new joint belief may be obtained directly by computing the belief of each component individually. The mixture components interact only during the calculation of the new mixture weights.

The more time steps are computed, however, the more diffused component beliefs become. Therefore, the mixture modeling of the filtering distribution may be recomputed by applying a function for reclustering, merging or splitting the components. The component distributions as well as associated weights may thereby be recalculated so that the mixture approximation before and after the reclustering procedure are equal in distribution while maintaining the probabilistic character of the weights and each of the distributions. This way, components may exchange probabilities and perform a tracking by taking the interaction of formants into account.

More specifically, assume that a function for merging, splitting and reclustering components exists and returns sets $R_1, R_2, \ldots, R_M$ for M components dividing the frequency range into contiguous formant specific segments. Then new mixture weights as well as component beliefs can be computed so that the mixture approximation before and after the reclustering procedure are equal in distribution. Furthermore, the probabilistic character of the mixture weights as well as the probabilistic character of the component beliefs is maintained because both still sum up to 1.

$$\pi'_{m,t} = \sum_{x_{k,t} \in R_m} \sum_{n=1}^{M} \pi_{n,t} \cdot Bel_n(x_{k,t}) \tag{9}$$

$$Bel'_m(x_{k,t}) = \begin{cases} \dfrac{\sum_{n=1}^{M} \pi_{n,t} \cdot Bel_n(x_{k,t})}{\pi'_{m,t}}, & \forall\, x_{k,t} \in R_m \\ 0, & \forall\, x_{k,t} \notin R_m \end{cases} \tag{10}$$

These equations show that previously overlapping probabilities switched their component affiliation. Thus, the components exchange parts of their probabilities in a manner that is dependent on mixture weight. Furthermore, it can be seen that mixture weights change according to the amount of probabilities a component gave and obtained. A mixture of consecutive but separated components is achieved and the multimodality is maintained as a result.

Up to this point, however, the existence of a segmentation algorithm for finding optimum component boundaries was only assumed. In one embodiment according to the present invention, the optimum component may be found by applying a dynamic programming based algorithm for dividing the whole frequency range into formant specific contiguous parts. To this end, a new variable $x_{k,t}^{(m)}$ is introduced, that specifies the assignment of state $x_k$ to segment m at time t.

Figure 2:
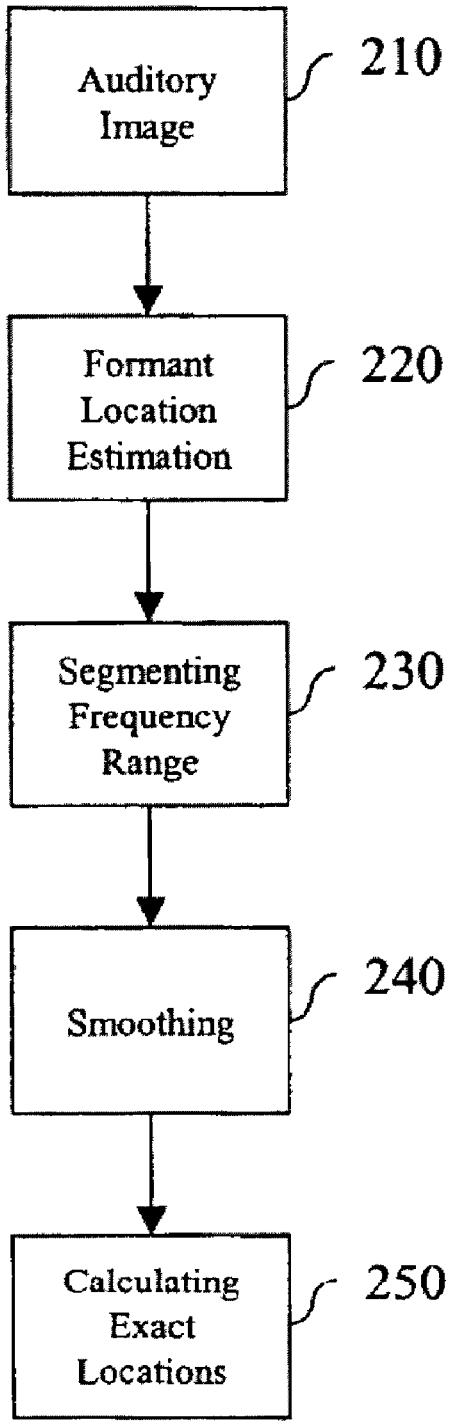
FIG. 2 is a flowchart illustrating a method for tracking formants, according to one embodiment of the invention.

FIG. 2 is a flowchart illustrating a method according to one embodiment of the invention. In this embodiment, the method is carried out in an automatic manner by a computing system comprising acoustical sensing means. In step 210, an auditory image of a speech signal is obtained by the acoustical sensing means. In step 220, formant locations are sequentially estimated. Then, in step 230, the frequency range is segmented into sub-regions. In step 240, the obtained component filtering distributions are smoothed. Finally, in step 250, the exact formant locations are calculated.

Figure 3:
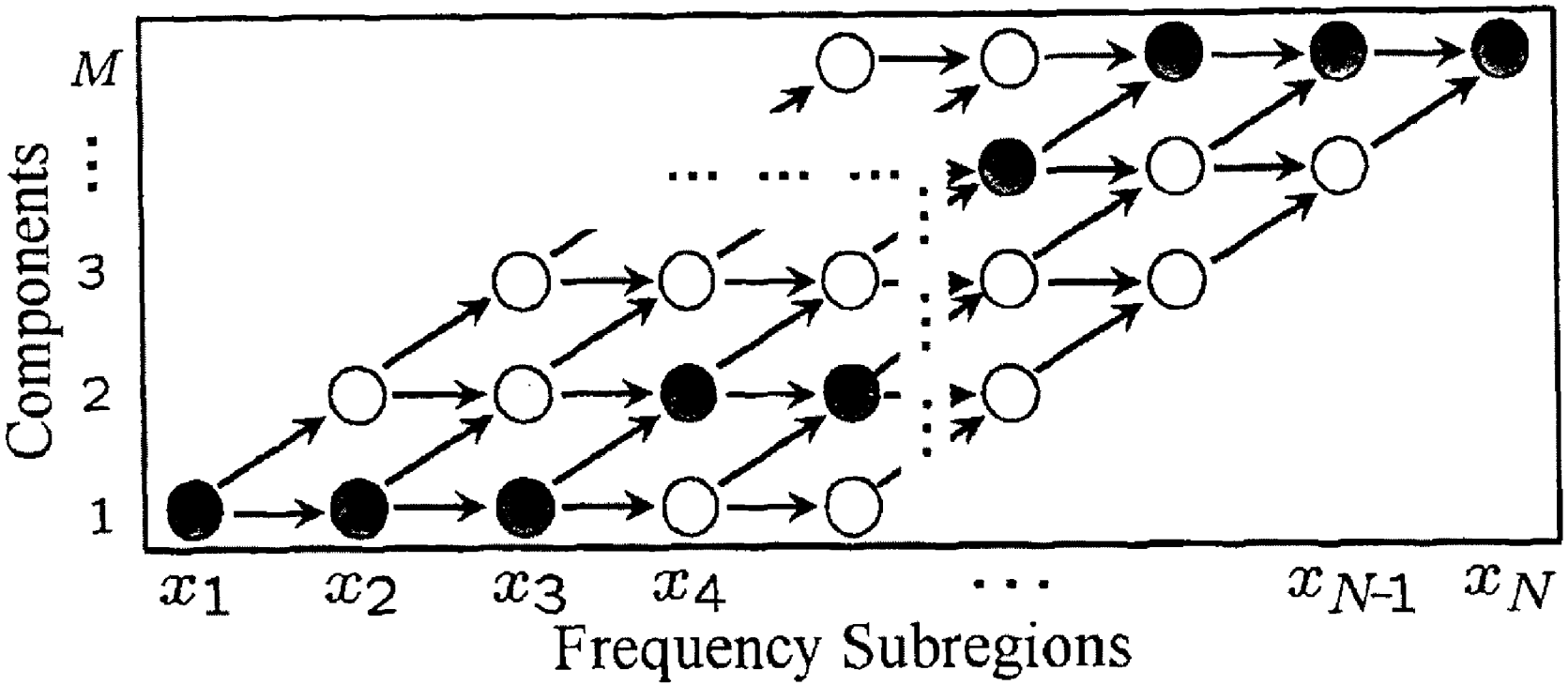
FIG. 3 is a diagram illustrating a trellis used for adaptive frequency range segmentation, according to one embodiment of the invention.

FIG. 3 is a trellis diagram illustrating all possible nodes representing the assignment of a frequency sub-region to a component that may be generated using this new variable. Furthermore, transitions between nodes are included in the trellis so that consecutive frequency sub-regions assigned to the same component as well as consecutive frequency subranges assigned to consecutive components are connected.

In each case, the transitions are directed from a lower frequency sub-range to a higher frequency sub-range. Additionally, probabilities were assigned to each node as well as to each transition.

Then, the formant specific frequency regions may be computed by calculating the most likely path starting from the node representing the assignment of the lowest frequency sub-region to the first component and ending at the node representing the assignment of the highest frequency sub-region to the last component.

Finally, each frequency sub-region may be assigned to the component for which the corresponding node is part of the most likely path so that contiguous and clear cut components are achieved.

More specifically, by formulating $x_{k,t}^{(m)}$ so that it becomes true only if the corresponding node to $x_{k,t}^{(m)}$ is part of a path from the lower left to the upper right, the problem of finding optimum component boundaries may be reformulated as calculating the most likely path through the trellis. Furthermore, all of the possible frequency range segmentations are covered by paths through the trellis while taking the sequential order of formants into account.

What remains is an appropriate choice of node and transition probabilities. In one embodiment of the present invention, the probabilities assigned to nodes may be set according to the a priori probability distributions of components and the actual component filtering distribution. The probabilities of transitions may be set to some constant value.

More specifically, the following formula may be used:

$$p(x_{k,t}^{(m)})=p_m(x_{k,0})\cdot Bel_m(x_{k,t}) \tag{11}$$

According to this formula, the likelihood of state $x_{k,t}^{(m)}$ depends on the a priori probability distribution function (PDF) of component m as well as the actual $m^{th}$ component belief. Because the belief represents the past segmentation updated according to the motion and observation models, this formula applies some data-driven segment continuity constraint. Furthermore, the a priori probability distribution function (PDF) used antagonizes segment degeneration by application of long-term constraints. The transition probabilities may not be easily obtained; and thus, the transition probabilities were set to an empirically chosen value. Experiments showed that a value of 0.5 for each transition probability is appropriate.

Finally, the most likely path can be computed by applying Viterbi algorithm. Any other cost-function may also be used instead of the mentioned probabilities. Furthermore, any other algorithm for finding the most likely, the cheapest or shortest path through the trellis may be used (for example, Dijkstra algorithm).

Using such algorithms for finding optimum component boundaries, the Bayesian mixture filtering technique may be applied. This method not only results in the filtering distribution, but it also adaptively divides the frequency range into formant specific segments represented by mixture components. Therefore, the following processing can be restricted to those segments.

Nevertheless, uncertainties already included in observations can not be resolved completely. The uncertainties result in diffused mixture beliefs at these locations.

Such limit of Bayesian mixture filtering is reasonable because it relies on the assumption that the underlying process (which states should be estimated) to be Markovian. Thus, the belief of a state $x_t$ only depends on observations up to time t. In order to achieve continuous trajectories, future observations must also be considered.

This is where Bayesian smoothing technique, for example, as disclosed in S. J. Godsill, A. Doucet, and M. West, "Monte Carlo smoothing for nonlinear time series," Journal of the American Statistical Association, vol. 99, no. 465, pp. 156-168, 2004, which is incorporated by reference herein in its entirety, comes into consideration. In one embodiment of the present invention, the obtained component filtering distributions may be spectrally sharpened and smoothed in time using Bayesian smoothing. Thus, the smoothing distribution may be recursively estimated based on predefined formant dynamics and the filtering distribution of components. This procedure works in the reverse time direction.

More specifically, let $\hat{B}el(x_t)$ denote the belief in state $x_t$ regarding both past and future observations. Then the smoothed component belief may be obtained by:

$$\hat{B}el_m^-(x_{k,t}) = \sum_{l=1}^{N} \hat{B}el_m(x_{l,t+1}) \cdot p(x_{l,t+1} \mid x_{k,t}) \tag{12}$$

$$\hat{B}el_m(x_{k,t}) = \frac{Bel_m(x_{k,t}) \cdot \hat{B}el_m^-(x_{k,t})}{\sum_{l=1}^{N} Bel_m(x_{l,t}) \cdot \hat{B}el_m^-(x_{l,t})} \tag{13}$$

As can be seen, the smoothing technique works in a way very similar to standard Bayes filters, but in reverse time direction. It recursively estimates the smoothing distribution of states based on predefined system dynamics $p(x_{t+1}|x_t)$ as well as the filtering distribution $Bel(x_t)$ in these states. By doing so, multiple hypothesis and ambiguities in beliefs are resolved.

In one embodiment of the invention, the Bayesian smoothing may be applied to component filtering distributions covering whole speech utterances. A block based processing may also be used in order to ensure an online processing. Furthermore, the Bayesian smoothing technique is not restricted to any kind of distribution approximation.

Then the exact formant locations are calculated. In one embodiment of the present invention, the $m^{th}$ formant location is set to the peak location of the $m^{th}$ component smoothing distribution.

That is, the calculation may be easily done by picking a peak such that the location of the $m^{th}$ formant at time t equals the peak in the smoothing distribution of component m because the component distributions obtained are unimodal.

$$F_m(t) = \underset{x_k}{\operatorname{argmax}}\,[\hat{B}el_m(x_{k,t})] \tag{14}$$

Any other techniques, for example, center of gravity can be used instead of the peak picking.

EXPERIMENTAL RESULTS

In order to evaluate the proposed method, some tests on the VTR-Formant database (L. Deng, X. Cui, R. Pruvenok, J. Huang, S. Momen, Y. Chen, and A. Alwan, "A database of vocal tract resonance trajectories for research in speech processing," Proceedings of the IEEE International Conference on Acoustics, Speech and Signal Processing (ICASSP), Toulouse, France, May 2006, pp. 60-63), a subset of the well known TIMIT database (J. S. Garofolo, L. F. Lamel, W. M. Fisher, J. G. Fiscus, D. S. Pallett, N. L. Dahlgren, and V. Zue, "DARPA TIMIT acoustic-phonetic continuous speech corpus," Tech. Rep. NISTIR 4930, National Institute of Standards and Technology, 1993) with hand-labeled formant trajectories for F1-F3 were used to estimate the first four formant trajectories. Accordingly, four components plus one extra component covering the frequency range above F4 were used during mixture filtering.

Figure 4:
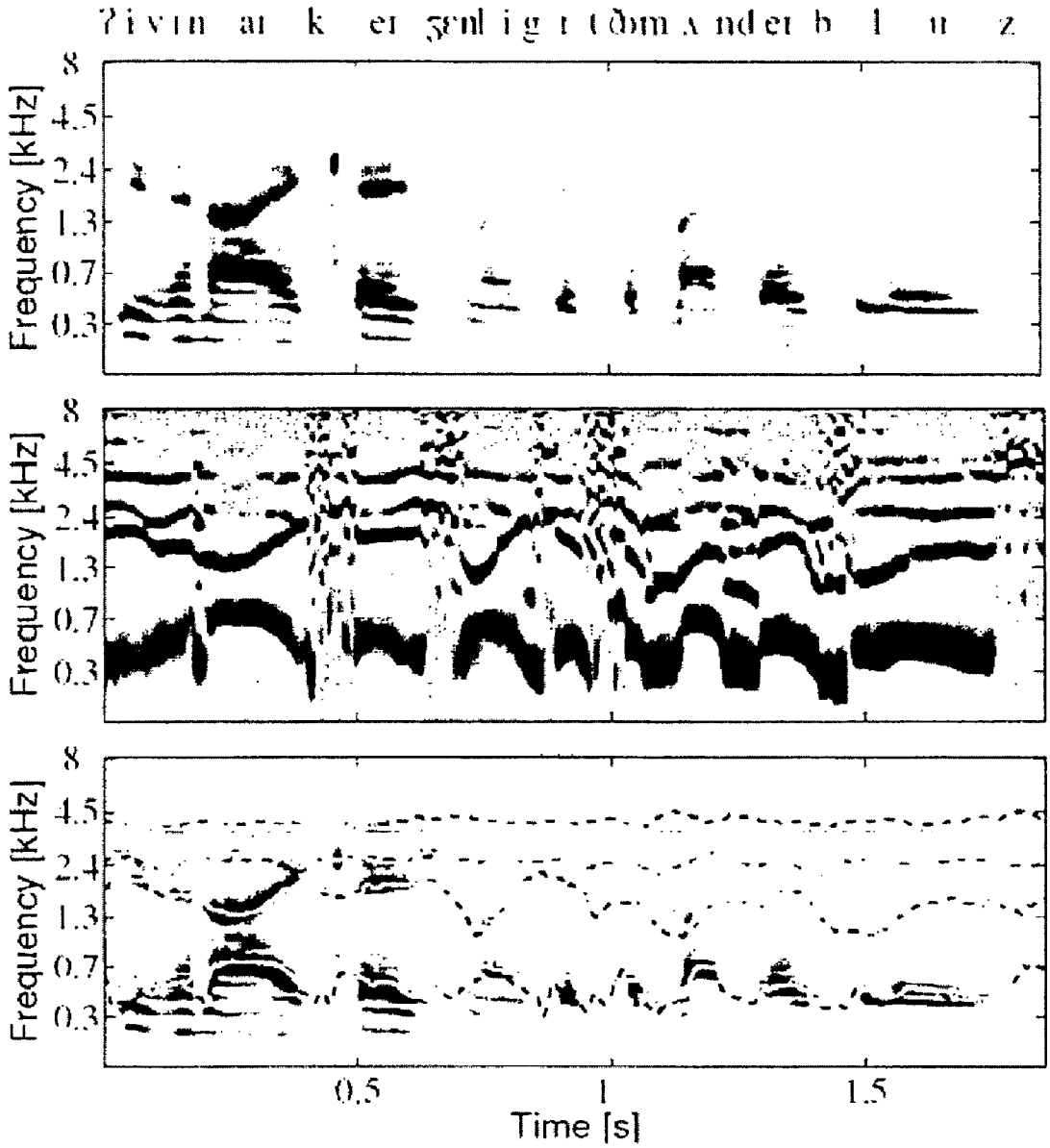
FIG. 4 is a diagram illustrating the results of an evaluation of a method according to an embodiment of the invention using an example drawn from a subset of VTR-Formant database.

FIG. 4 is a diagram illustrating the results of an evaluation of a method according to an embodiment of the invention using a typical example drawn from a subset of the VTR-Formant database. FIG. 4 illustrates the original spectrogram, the formant enhanced spectrogram, and the estimated formant trajectories at the top, middle and bottom, respectively.

Further, a comparison to a state of the art approach as disclosed in K. Mustafa and I. C. Bruce, "Robust formant tracking for continuous speech with speaker variability," IEEE Transactions on Audio, Speech and Language Processing, vol. 14, no. 2, pp. 435-444, 2006 was performed. The training and test set of the VTR-Formant database were used for consideration of a total of 516 utterances.

The following table shows the square root of the mean squared error in Hz as well as the corresponding standard deviation (in brackets) calculated in the time step of 10 ms. Additionally, the results were normalized by the mean formant frequencies resulting in measurements in percentage (%).

| Formant | | Gläser et al. | | Mustafa et al. | |
|---|---|---|---|---|---|
| F1 | in Hz | 142.08 | (225.60) | 214.85 | (396.55) |
| | in % | 27.94 | (44.36) | 42.25 | (77.97) |
| F2 | in Hz | 278.00 | (499.35) | 430.19 | (553.98) |
| | In % | 17.51 | (31.45) | 27.10 | (34.89) |
| F3 | in Hz | 477.15 | (698.05) | 392.82 | (516.27) |
| | in % | 18.78 | (27.47) | 15.46 | (20.32) |

The table shows that the proposed method clearly outperforms the state of the art approach proposed by Mustafa et al. at least for the first two formants. Because these are the most important formants with respect to the semantic message, these results show a significant performance improvement in speech recognition and speech synthesis systems.

A method for the estimation of formant trajectories is disclosed that relies on the joint distribution of formants rather than using independent tracker instances for each formant. By doing so, interactions of trajectories are considered, which improves the performance, among other instances, when the spectral gap between formants is small. Further, the method is robust against noise and clutter because Bayesian techniques work well under such conditions and allow the analysis of multiple hypotheses per formant.

While particular embodiments and applications of the present invention have been illustrated and described herein, it is to be understood that the invention is not limited to the precise construction and components disclosed herein and that various modifications, changes, and variations may be made in the arrangement, operation, and details of the methods and apparatuses of the present invention without departing from the spirit and scope of the invention as it is defined in the appended claims.

What is claimed is:

1. A computer based method of tracking formant frequencies in a speech signal, the method comprising:

obtaining a spectrogram on the speech signal;

obtaining component filtering distributions by applying Bayesian Mixture Filtering to the spectrogram;

segmenting a frequency range into sub-regions based on the component filtering distributions;

smoothing the obtained component filtering distributions using Bayesian smoothing; and calculating exact formant locations based on the smoothed component filtering distributions.

2. The method of claim 1, wherein a joint distribution $Bel(x_t)$ of a recursive Bayesian filter is expressed as $$Bel(x_t) = \sum_{m=1}^{M} \pi_{m,t} \cdot Bel_m(x_t)$$

where M is the number of component beliefs, t is time, $\pi_{m,t}$ with m=1, . . . , M are mixture weights in a M-component mixture model at time t, and $Bel_m(x_t)$ is a non-parametric mixture of M component beliefs.

3. The method of claim 2, wherein prediction of the recursive Bayesian filter is expressed as $$Bel^{-}(x_{k,t}) = \sum_{m=1}^{M} \pi_{m,t-1} \cdot Bel_m^{-}(x_{k,t-1})$$

and the update step of the recursive Bayesian filter is expressed as $$Bel(x_{k,t}) = \sum_{m=1}^{M} \pi_{m,t} \cdot Bel_m(x_{k,t}),$$

where $$Bel_m^{-}(x_{k,t}) = \sum_{l=1}^{N} p(x_{k,t} \mid x_{l,t-1}) Bel_m(x_{l,t-1}),$$

$$Bel_m(x_{k,t}) = \frac{p(z_t \mid x_{k,t}) Bel_m^{-}(x_{k,t})}{\sum_{l=1}^{N} p(z_t \mid x_{l,t}) Bel_m^{-}(x_{l,t})}, \text{ and}$$

$$\pi_{m,t} = \frac{\pi_{m,t-1} \sum_{k=1}^{N} p(z_t \mid x_{k,t}) Bel_m^{-}(x_{k,t})}{\sum_{n=1}^{M} \pi_{n,t-1} \sum_{l=1}^{N} p(z_t \mid x_{l,t}) Bel_n^{-}(x_{l,t})}.$$

4. The method of claim 1, wherein the segmenting step includes the step of calculating an optimal path according to a cost function.

5. The method of claim 4, wherein the optimal path for the segmenting is calculated using Viterbi algorithm.

6. The method of claim 4, wherein the optimal path for the segmenting is calculated using Dijkstra algorithm.

7. The method of claim 1, further comprising learning a motion model of Bayesian filtering.

8. The method of claim 7, wherein the learning of the motion model of the Bayesian filtering of a current time step takes previous time steps into account.

9. The method of claim 7, wherein the learning of the motion model of the Bayesian filtering takes interaction of the different formants into account.

10. The method of claim 1, wherein smoothing the obtained component filtering distributions comprises Bayesian smoothing.

11. The method of claim 10, wherein the Bayesian smoothing recursively estimates smoothing distribution of states based on predefined system dynamics $p(x_{t+1}|x_t)$ and filtering distribution $Bel(x_t)$ of the states, where $p(x_{t+1}/x_t)$ is a probability distribution over possible formant locations x at time t+1, given knowledge about formant locations at time t.

12. The method of claim 1, further comprising preprocessing of the speech signal, and performing speech recognition based on the exact formant locations.

13. The method of claim 1, further comprising performing artificial formant-based speech synthesis based on the exact formant locations.

14. A computer program product comprising a non-transitory computer readable medium structured to store instructions executable by a processor in a computing device, the instructions, when executed cause the processor to:

obtain a spectrogram on a speech signal;

obtain component filtering distribution by applying Bayesian Mixture Filtering of the spectrogram;

segment a frequency range into sub-regions based on the component filtering distributions;

smooth the obtained component filtering distributions using Bayesian smoothing; and calculate exact formant locations based on the smoothed component filtering distributions.

* * * * *